US010024633B2

(12) United States Patent
Horch

(10) Patent No.: US 10,024,633 B2
(45) Date of Patent: Jul. 17, 2018

(54) RAPID ARMOR PANEL SYSTEM

(71) Applicant: Action Target Inc., Provo, UT (US)

(72) Inventor: Chad Horch, Lehi, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 15/397,420

(22) Filed: Jan. 3, 2017

(65) Prior Publication Data

US 2017/0205206 A1 Jul. 20, 2017

Related U.S. Application Data

(60) Provisional application No. 62/278,659, filed on Jan. 14, 2016.

(51) Int. Cl.

| | |
|---|---|
| ***F41H 5/24*** | (2006.01) |
| ***F41H 5/013*** | (2006.01) |
| ***E04B 1/92*** | (2006.01) |
| *E04H 9/04* | (2006.01) |

(52) U.S. Cl.

CPC ..... *F41H 5/24* (2013.01); *E04B 1/92* (2013.01); *F41H 5/013* (2013.01); *E04H 9/04* (2013.01)

(58) Field of Classification Search

CPC ... F41H 5/24; F41H 5/013; E04H 9/04; E04B 1/92

See application file for complete search history.

(56) References Cited

U.S. PATENT DOCUMENTS

| | | | |
|---|---|---|---|
| 774,959 | A | 11/1904 | Tresidder |
| 867,406 | A | 10/1907 | Pates |
| 980,255 | A | 1/1911 | Herms et al. |
| 1,035,908 | A | 8/1912 | Richardson |
| 1,155,717 | A | 10/1915 | Fouts |
| 1,199,357 | A | 9/1916 | Evans, Jr. |
| 1,724,601 | A | 8/1929 | Kellogg |
| 1,803,514 | A | 5/1931 | Thomas |
| 1,957,933 | A | 5/1934 | Brandl |
| 2,054,665 | A | 9/1936 | Tracy |
| 2,080,230 | A | 5/1937 | Ray |
| 2,103,407 | A | 12/1937 | Dean |
| 2,105,784 | A | 1/1938 | Hagberg |
| 2,160,225 | A | 5/1939 | Newman |
| 2,170,637 | A | 8/1939 | Hatch et al. |
| 2,208,010 | A | 7/1940 | Whitmore |
| 2,209,580 | A | 7/1940 | Sargent |
| 2,212,982 | A | 8/1940 | Drain, Jr. et al. |
| 2,213,402 | A | 9/1940 | Lowry |

(Continued)

FOREIGN PATENT DOCUMENTS

| | | |
|---|---|---|
| AU | 127432 | 4/1946 |
| AU | 202340 | 8/1954 |

(Continued)

OTHER PUBLICATIONS

Caswell International Corp., Bullet Trap Design, Circa 2002.

(Continued)

*Primary Examiner* — Andrew J Triggs

(74) *Attorney, Agent, or Firm* — Durham Jones & Pinegar; Randall B. Bateman; Sarah W. Matthews

(57) ABSTRACT

A rapid armor panel system includes a patch panel which can be attached to a joint strip on a modular ballistic wall so as to cover a damaged area of a ballistic plate in the wall.

20 Claims, 6 Drawing Sheets

(56) References Cited

U.S. PATENT DOCUMENTS 2,229,064 A 1/1941 Finch
2,231,528 A 2/1941 Daniels
2,269,490 A 1/1942 Slick
2,328,197 A 8/1943 Cowin
2,350,827 A 6/1944 Saulnier
2,376,279 A 5/1945 Schlenkert
2,410,922 A 11/1946 Balduf
2,412,242 A 12/1946 Beaud
2,535,280 A 12/1950 Gartrell
2,738,094 A 3/1956 Fowler
2,838,592 A 5/1958 Feketics
2,855,871 A 10/1958 Huntington
2,905,283 A 9/1959 Leach
2,912,013 A 11/1959 Freyholdt
2,927,665 A 3/1960 Hauf
2,932,860 A 4/1960 Barth
2,978,531 A 4/1961 Appleman
3,004,644 A 10/1961 Hull
3,082,848 A 3/1963 Keller
3,263,385 A 8/1966 Pauls
3,295,283 A 1/1967 Griffith
3,359,700 A 12/1967 Birum
3,394,526 A 7/1968 Englebrecht
3,398,496 A 8/1968 Mischke
3,423,891 A 1/1969 Burris
3,423,896 A 1/1969 Widerby
3,485,405 A 12/1969 Dement
3,508,302 A 4/1970 Settanni
3,530,633 A 9/1970 Scott
3,619,437 A 9/1971 McDonald
3,715,843 A 2/1973 Ballinger
3,748,793 A 7/1973 Tompkins et al.
3,927,500 A 12/1975 Plumlee
3,969,855 A 7/1976 Lendi
4,027,454 A 6/1977 Schuplin
4,028,856 A 6/1977 Dalbec
4,062,164 A 12/1977 Cousins
4,254,600 A 3/1981 Zwissler
4,317,572 A 3/1982 Iseli
4,455,803 A 6/1984 Kornberger
4,567,100 A 1/1986 Pickett et al.
4,599,831 A 7/1986 Magaha, Jr.
4,723,749 A 2/1988 Carraro et al.
4,854,248 A 8/1989 Salzer
4,891,920 A 1/1990 Pingston
4,937,994 A 7/1990 Ritter
4,967,530 A 11/1990 Clunn
5,040,802 A 8/1991 Wojcinski et al.
5,050,363 A * 9/1991 Fornell ..... E06B 5/106 109/58
5,127,340 A 7/1992 Maro et al.
5,170,604 A 12/1992 Hedly
5,423,150 A 6/1995 Hitchcock
5,456,155 A 10/1995 Myrtoglou
5,579,794 A 12/1996 Sporta
5,592,789 A 1/1997 Liddell, Sr. et al.
5,600,084 A 2/1997 Gonzalez
5,603,193 A 2/1997 Koertge et al.
5,663,520 A 9/1997 Ladika et al.
5,670,734 A 9/1997 Middione et al.
5,748,072 A 5/1998 Wang
5,749,177 A 5/1998 Pontus et al.
5,749,671 A 5/1998 Chauquet
5,752,835 A 5/1998 Whitmer
5,779,068 A 7/1998 Whiten et al.
5,791,090 A 8/1998 Gitlin et al.
5,860,251 A 1/1999 Gleich
5,906,493 A 5/1999 Bishop
5,915,449 A 6/1999 Schwartz
6,027,120 A 2/2000 Wojcinski et al.
6,082,240 A 7/2000 Middione
6,179,620 B1 1/2001 Schmid
6,286,269 B1 9/2001 Marcum
6,415,557 B1 7/2002 McCalley
6,438,906 B1 8/2002 Komarowski et al.
6,449,917 B1 9/2002 Sullivan, III
6,453,621 B1 9/2002 Bundy, Jr. et al.
6,547,483 B2 4/2003 Rae-Smith
6,845,701 B2 1/2005 Drackett
6,865,852 B2 3/2005 Gower
6,877,988 B2 4/2005 Phillips et al.
7,074,043 B1 7/2006 Jacobson
7,117,644 B2 * 10/2006 Dehart ..... E04H 9/10 52/36.1
7,117,645 B2 10/2006 Bzorgi
7,234,890 B1 * 6/2007 Marshall ..... F41J 13/00 273/410
7,520,207 B1 * 4/2009 Fuqua ..... F41H 5/013 109/82
7,866,106 B2 * 1/2011 Bowlware ..... E01F 13/12 404/6
8,001,880 B2 * 8/2011 White ..... E01F 13/12 404/6
8,371,207 B2 * 2/2013 White ..... E01F 13/12 404/6
8,414,067 B2 4/2013 Howard et al.
8,590,439 B2 * 11/2013 White ..... E01F 13/12 404/6
8,615,947 B2 12/2013 Underkofler et al.
2005/0050816 A1 3/2005 Manning et al.
2006/0151770 A1 7/2006 Payne
2006/0248827 A1 * 11/2006 Meeker ..... E04H 9/10 52/309.15
2008/0010932 A1 1/2008 Elliot et al.
2008/0019769 A1 * 1/2008 Marshall ..... F41J 13/00 403/408.1
2008/0271652 A1 * 11/2008 White ..... E01F 13/12 109/49.5
2008/0314237 A1 12/2008 Cioffi
2009/0100997 A1 * 4/2009 Fuqua ..... F41H 5/013 89/36.02
2013/0284002 A1 * 10/2013 White ..... E01F 13/12 89/36.01
2015/0308792 A1 * 10/2015 Tyler ..... F41H 5/013 89/36.02
2017/0205206 A1 * 7/2017 Horch ..... F41H 5/24

FOREIGN PATENT DOCUMENTS

CH 597 451 4/1978
DE 227 342 10/1910
DE 498 308 5/1930
DE 514 123 12/1930
DE 877 489 5/1953
DE 20 21 170 11/1971
DE 36 35 741 7/1992
EP 2343218 7/2011
FR 832.754 10/1938
FR 849.829 12/1939
FR 1.156.211 5/1958
FR 2.461.069 7/1980
GB 280832 11/1927
GB 725189 3/1955
JP 6015635 2/1994
KR 10-2010-0013235 2/2011
NL 7700295 7/1978

OTHER PUBLICATIONS

Caswell International Corp., Bullet Trap Product Literature, Circa 2002.
Caswell International Corp., Product Literature, Copyright 2002.
Declaration of Kyle Bateman re Bullet Trap Design Circa 2001.
Duelatron, Product Literature 1995.
www.letargets.com. Breach training door. Circa 2005.
www.mgmtargets.com. Breach training door Circa 2005.
Porta Target, Product Literature, Circa 2000.
Porta Target, Shoot House Product Literature, Circa 2000.
Savage Arms, Shoot House Bid and Specification, Bid dated Oct. 1998.
ST Bullet Containment Sytems, Inc. Product Literature, Circa 2002.

(56) References Cited

OTHER PUBLICATIONS

Trussed Concrete Steel Co., Youngstown, Ohio, Copyright 1903, Product Literature.

* cited by examiner 34a
46b
46a
46b
34
58
54
50
38
42
42
46
50
34
38
46
46b
46a
42
42
42
58
42
50
46a
46b
30
46
42
42
42
42
38
42
46a
46b
46b
46a
46b
46a
46b
46a

RAPID ARMOR PANEL SYSTEM

THE FIELD OF THE INVENTION

The present invention relates to ballistic modular walls as may be used in shoot houses and the like. More specifically, the present invention relates to a panel system which can be used to prolong the life of individual panels in ballistic walls while keeping costs to a minimum.

BACKGROUND

In order to maintain proficiency in the use of firearms, it is common for law enforcement officers, members of the military and sportsmen to engage in target practice. While many perceive target practice as simply a method for improving accuracy, it is important for law enforcement officers, members of the military and the like to conduct target practice in scenarios which improve timing and the ability to make split-second decisions on whether or not to fire their weapon. Such split-second decisions can mean the difference between life and death both for the officer or soldier and those around them. For example, a police officer who fires too quickly may shoot an unarmed person. If he or she delays too long, however, a perpetrator may shoot a bystander or the officer.

One of the most dangerous situations for law enforcement officers is entry of a home. Behind each wall could be a threat to officers or others. This is particularly true in domestic violence situations. Therefore, it is critical for law enforcement officers to learn how to properly clear a house, and how to contain dangerous criminals.

In order to better train law enforcement officers for such scenarios, training ranges have been made out of ballistic walls configured in arrangements to resemble a house or other building. This type of structure, typically referred to as a "shoot house," enables law enforcement officers to train in situations in which the officer faces realistic threats to their safety in an environment which is similar to that in which the real threats will be encountered. With proper training, officers are more confident and are better able to deal with situations in which a real threat is present, and also to avoid tragedy due to misreading the situation.

Shoot houses were originally constructed out of concrete, gravel filled walls, or tire walls. While these shoot houses provided marked improvement over traditional training, they still do not feel as realistic as conventional looking walls having a comparable thickness to the walls in a home. A significant improvement in shoot houses was achieved with the invention of modular shoot house walls in which plates of steel were attached together in a ballistically sound manner and then covered by a frame. A more detailed description of a construction of a shoot house is set forth in U.S. Pat. No. 5,822,936.

While hardened steel panels enable the shoot house to appear much more realistic during training, the panels can be damaged over time. This is particularly so if a high volume of rounds impact a relatively small area. Thus, for example, if shoot house training scenarios frequently place a target in the corner of a room farthest from the door, the plates which form that corner will usually receive a high number of rounds. After a certain number of rounds have impacted the steel plate in a particular area, that area of the plate becomes compromised and should be repaired or replaced.

One solution to a damaged plate has been to weld a patch over the affected area. Thus, as shown in FIG. 1, a new piece of steel 4 is welded onto a plate 8 to cover a damaged area, represented by dashed line 12 and thereby ensure that there is no bullet penetration. Welding, however, creates problems of its own, as welding hardened steel can weaken the steel and make the surrounding area more susceptible to penetration. Additionally, welding may be difficult if the damaged area is adjacent the facing strips 16 which hold the plates 8 together. (Bolts (not shown) typically extend through the facing strip 16 and a similar backing strip (not shown) to hold the plates together. The modular wall also typically has a façade of wood or rubber spaced apart from the plates 8 to catch any projectiles or projectile fragments and prevent them from splattering back toward the shooter or others in the shoot house).

Another solution to the issue of damaged plates is the use of what has been referred to as a belly band. Shooting too close to the top or bottom of the ballistic wall raises the risk of ricochets and bullets escaping the shoot house. Thus, the targets are usually placed at least two feet above the ground and two feet below the top of the ballistic wall. To prevent bullets from eventually penetrating the wall, a set of initial impact plates 20 may be attached to the facing strips 16 and thereby cover the center portion of the plates 8 and thereby reduce the risk of penetration. The initial impact plates 20 may be 4'×3', 4'×4' or 4'×6' depending on the amount of amount of additional protection desired, thereby leaving only the top and bottom 1-3 feet susceptible to an initial impact.

While such a system is effective at reducing the risk of penetration, it also adds considerable cost to the shoot house. This is particularly so as many walls of the shoot house take fire from both sides. If the initial impact plates 20 are used on both sides, the amount of steel used in the shoot house doubles, substantially raising the cost of the shoot house. Additionally, the initial impact plates also must be checked and either patched as shown in FIG. 1 or replaced when damaged. Additionally, the use of the initial impact plates can complicate the manner in which a façade used for containing bullet splatter is attached.

Thus, there is a need for an improved method for protecting against bullet penetration while minimizing cost.

SUMMARY OF THE INVENTION

Embodiments of a rapid armor panel system which reduces the risk of bullet penetration are disclosed below. The system includes a variety of inventive aspects which can be used together to reduce the risk of bullet penetration. It will be appreciated that various aspects of the invention can be used independently or together and that the invention is set forth in the attached claims rather than the description contained herein.

BRIEF DESCRIPTION OF THE DRAWINGS

Various embodiments and features of target systems are shown and described in reference to the following numbered drawings:

FIG. 8 shows a fragmented, cross-sectional view of a ballistic wall formed by ballistic panels, joint strips, furring strips and a façade, along with a patch panel.

Figure 1:
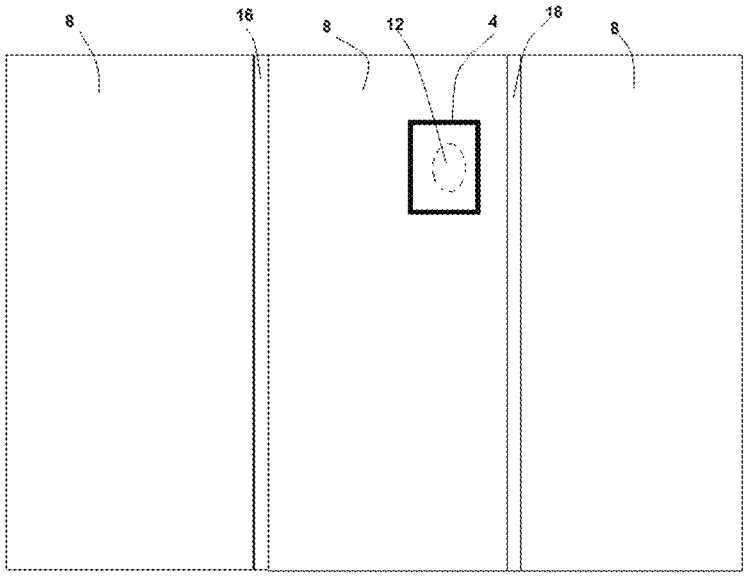
FIG. 1 (Prior Art)
FIG. 1 shows front view of a ballistic wall made in accordance with the principles of the prior art.
Figure 2:
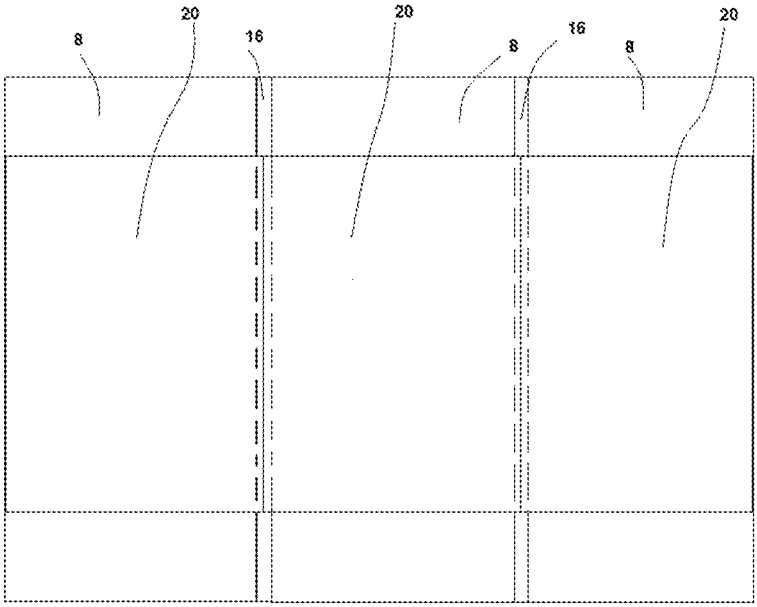
FIG. 2 (Prior Art)
FIG. 2 shows a front view of a ballistic wall made in accordance with the principles of the prior art.

It will be appreciated that the drawings are illustrative and not limiting of the scope of the invention which is defined by the appended claims. The embodiments shown accomplish various aspects of the invention. It is appreciated that it is not possible to clearly show each element and aspect of an invention in a single figure, and as such, multiple figures are presented to separately illustrate the various details of embodiments of target systems in greater clarity. Several aspects from different figures may be used in accordance with target systems in a single structure. Similarly, not every embodiment need accomplish all advantages of various embodiments of a rapid armor panel system.

DETAILED DESCRIPTION

The invention and accompanying drawings will now be discussed in reference to the numerals provided therein so as to enable one skilled in the art to practice the present invention. The skilled artisan will understand, however, that the apparatuses, systems and methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present disclosure is not limited to any particular structures, process steps, or materials discussed or disclosed herein, but is intended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or configurations shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a plate" may include one or more of such plates, and reference to "the backing" may include reference to one or more of such layers.

As used herein, the term "substantially" refers to the complete or nearly complete extent or degree of an action, characteristic, property, state, structure, item, or result to function as indicated. For example, an object, such as tubing, that is "substantially" enclosed would mean that the object is either completely enclosed or nearly completely enclosed. The exact allowable degree of deviation from absolute completeness may in some cases depend on the specific context, such that enclosing nearly all of the length of a piece of tubing would be substantially enclosed, even if the distal end of the structure enclosing the tubing had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

Likewise, the term generally is used to identify a situation in which some is close enough that it would commonly be considered to be a described feature, position, etc., even though it is not exactly so. For example, a structure may be said to be generally vertical even though it is not exactly 90 degrees from the horizontal. In other words, a plate held at an angle 80 degrees above horizontal may be said to be generally vertical. The exact range will be determined by the ordinary usage of a person of ordinary skill in the art.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Figure 3:
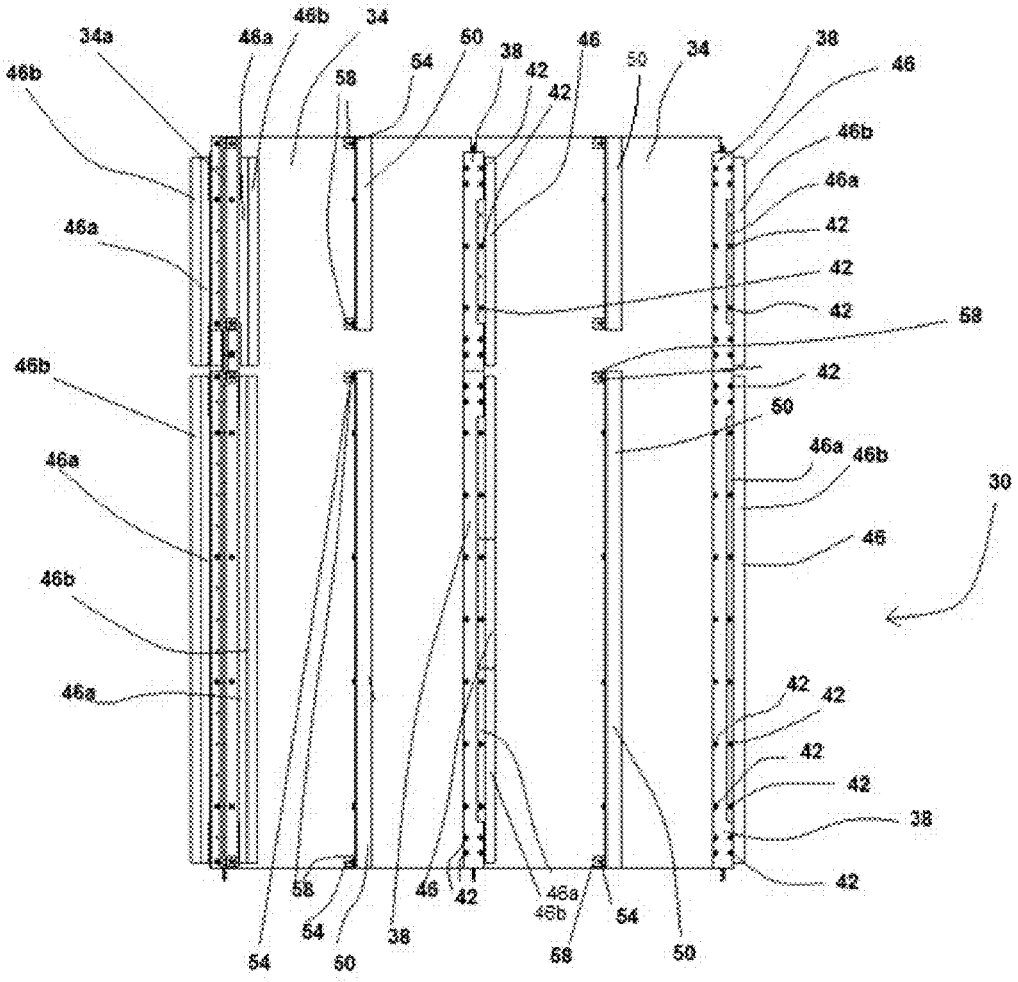
FIG. 3 shows a front view of a ballistic wall made in accordance with principles of the prior art.

Turning now to FIG. 3, there is shown a side view of a portion of a modular ballistic wall as may be found in certain shoot houses produced by Action Target Inc., Provo, Utah. The modular ballistic wall, generally indicated at 30 includes a plurality of ballistic plates 34. Typically, the ballistic plates 34 are made from hardened steel, such as AR500, though other materials may be used. A variety of thicknesses may be used, typically ranging from ⅜ to ½ inch thick, though other thicknesses may be used.

The ballistic plates 34 are held together by a plurality of joint strips 38, which are likewise made from steel or similar material. The ballistic panels 34 may have holes or keyholes (not shown) formed along their edges and the joint strips 38 may have a plurality of holes (not shown) which align with the holes or keyholes in the ballistic plates. A plurality of bolts 42 (only some of which are labeled for clarity) may be passed through the holes in the joint strips 38, the holes or keyholes in the panels 34 (if present) and a complementing joint strip (not shown) on the back side of the ballistic plates. When nuts are tightened on the bolts 42 the adjacent edges of the ballistic plates are held together and bullets cannot typically pass between the ballistic plates.

A façade to contain bullet fragments and the like is typically attached to the ballistic wall 30. This can be done in a variety of ways. For example, as shown in FIG. 3, a furring strip 46 may be attached to joint strips 38. While the furring strips 46 and joint strips 38 may extend the length of the ballistic plate 34, a plurality of joint segments and furring strip segments can also be used.

As shown in FIG. 3, the furring strips 46 are generally Z-shaped in cross-section. A lower portion 46*a* has openings (either holes or cut-outs) which can be received under the head of the bolt or the associated nut passing through the joint strips 38 to hold the lower portion of the furring strip 46 to the joint strip. The upper portion 46*b* can then be used to attach the façade, such as by screwing plywood or rubber panels (not show) to the upper portion. When the façade is attached, the furring strips 46 space the façade away from the ballistic plates 34 and the joint strips 38 so that a bullet passing through the façade impacts the ballistic plates and/or joint strips and ricochets into contact with the façade which contains the bullet fragments. If a furring strip 46 is damaged the bolts only need be loosened and the furring strip replaced.

In embodiments where the façade is made of rubber panels, it is often desirable to add additional support to the panels to prevent bowing and the like. This may be done by secondary furring strips 50 which are attached to the ballistic plates 34 between the joint strips 38 by bolts 54 and brackets 58. The secondary furring strips 50 are used to attach the façade in a similar manner to that discussed above. While the furring strips 46, 50 discussed above are typically made at least partly from aluminum or thin gauge steel sheet metal, other materials, including wood, can be used. For example, the secondary furring strips 50 are formed from an L-shaped piece of aluminum or steel sheet metal which is attached to a strip of hardened steel which extends perpendicular to the ballistic plates. The hardened steel strip receives the impact of bullet splatter moving between the ballistic panel and the façade, thereby reducing damage to the furring strips.

Also shown in FIG. 3, a ballistic plate 34*a* is attached on the left side extending generally orthogonally or perpendicular to the other two ballistic plates so that only the end view can be seen. Such attachments are common in order for the ballistic plates to be positioned to form walls of a shoot house resembling a conventional house.

While the structure shown in FIG. 3 is a desirable shoot house, over time the ballistic plates 34 will get damaged due to being repeatedly impacted by high speed projectiles such as bullets. When the ballistic plates 34 have been dented to a sufficient depth or had a sufficient number of rounds impact the plates in a particular area, it has been necessary to repair or replace the plates as discussed above.

In accordance with the present invention, a system is provided to repair the shoot house without requiring a new plate to be welded over a damaged area, or providing extensive extra steel which will increase the cost of the shoot house.

Figure 4:
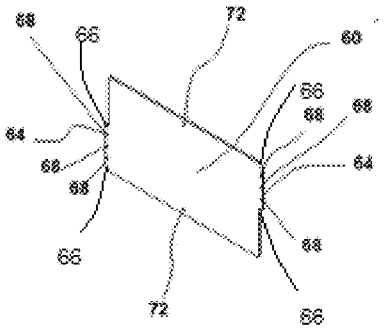
FIG. 4 shows a perspective view of a patch panel used in conjunction with a ballistic wall, such as that shown in FIG. 3.

Turning now to FIG. 4 there is shown a patch panel 60 formed in accordance with the principles of the present invention. The patch panel 60 may be formed from plate of ballistic material, such as hardened steel, e.g. AR 500 steel typically between ⅜$^{th}$ and ½ inch thick, though other thicknesses may be used. The patch panel 60 defines a body. A pair of projections or tabs 64 may be disposed on generally opposite sides of the body to extend therefrom. As show in FIG. 4, one tab extends from an upper portion of the body, while the other extends from a lower portion of the body. The tabs 64 may be offset from one other such that if multiple patch panels 60 were placed end to end, the tab 64 of one plate could be positioned above the tab of the other on the adjacent ends. As shown the tabs 64 may leave recesses 66 both above and below the tab to facilitate working with the bolts and will be discussed below.

The tabs 64 may include a plurality of keyholes or holes (collectively referred to as holes) 68 which are sized to receive bolts to hold the patch panel to a joint strip. As will be explained in additional detail below, the patch panel 60 can be placed over an area of damage to the ballistic plate 34 (FIG. 3) to thereby cover the ballistic plate and avoid the need to either weld a patch onto the plate (thereby potentially compromising the integrity of the ballistic plate), while avoiding the substantial cost of using a belly band.

Also shown in FIG. 4 is a pair of furring holes 72 which are formed in the patch panel 60. The furring holes 72 allow for the attachment of the secondary furring strips 50 (FIG. 3) if needed.

Figure 5:
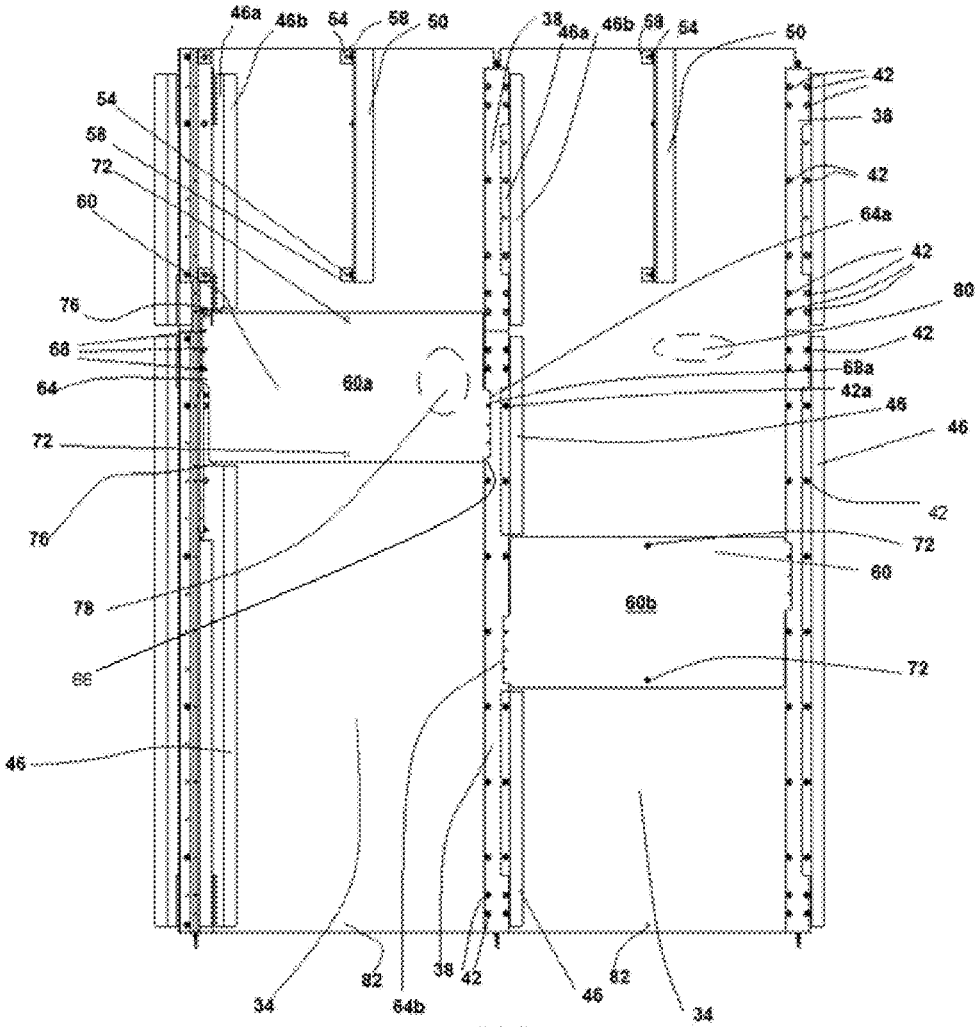
FIG. 5 shows a front view of a ballistic wall panel similar to that shown in FIG. 3 with two of the secondary furring strips being removed and two patch panels attached to the joint strips.
Figure 6:
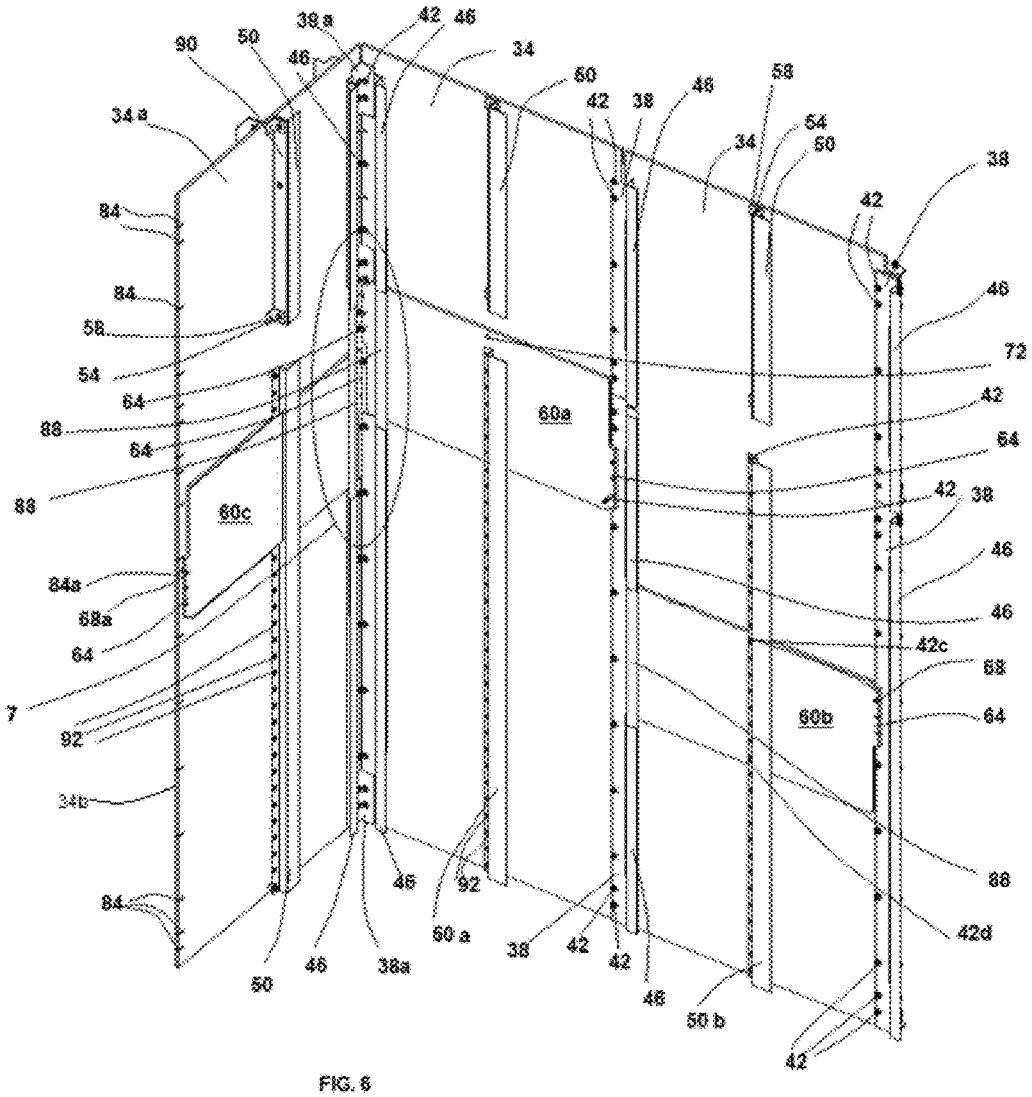

Turning now to FIG. 5, there is shown a front view of a ballistic wall section similar to that shown in FIG. 3. All of the structures are the same except those discussed below, labeling of some of the parts has been omitted, however, for clarity.

In FIG. 5 the lower secondary furring strips 50 (FIG. 3) have been removed and a pair of patch panels 60 inserted. On the right-hand side of each of the patch panels 60, one or more holes 68 in the tab 64 can be used to receive a bolt 42 passing through the left side of one of the joint strips 38. On the left-hand side of each patch panel 60, however, the tab 64 would be located in the same position as the lower portion 46*a* of the furring strips 46 which are attached along the right-hand column of bolts 42 on the joint strips 38. To accommodate the patch panels 60, the portion of the furring strips 46 where the left side of the patch panels 60 are to attach to the joint strips 38 can be removed (such as being cut out with tin snips or the like) or smaller pieces of furring strip may be used so as to create a gap for receiving the side of the patch panel 60. Thus, numerals 76 on the left side of the figure show where the furring strip 46 has been cut away to receive the patch panel 60*a*.

The holes 68 in the tab 64 of the patch panel can be used to adjust the vertical position of the patch panel 60 by aligning a particular hole with the location of one of the bolts. Thus, for example, in patch panel 60*a*, the upper most hole 68*a* in the right tab 64*a* is in alignment with the bolts 42*a* in the joint strip 38. If the patch panel 60 needed to be moved up several inches, one of the lower holes could be placed in alignment with the bolt and a longer bolt could be used on the left-hand side if needed to accommodate the thickness of the patch panel.

As was noted previously, the tabs 64 of the patch panels 60 may be sized so that they can overlap one another if placed end to end. Thus, for example, if the ballistic wall had a first damaged area 78 and a second damaged area 80, the second patch panel 60*b* could be attached immediately adjacent to the first patch panel 60*a*. If the joint strips 38 were too narrow to accommodate the tabs 64*a* and 64*b* being end to end, the second patch panel 60*a* could simply be inverted so that the tap 64*b* was on top, thereby allow the tabs to overlap vertically.

One advantage of the present invention is that it provides a fairly customizable solution for covering potential weak spots in ballistic plates 34. Multiple patch panels 60 could be used to cover a single ballistic plate 34 which suffers substantial wear while minimizing the expense of using multiple ballistic plates in the manner shown above with respect to the prior art. Additionally, adding a patch panel 60 can be done quickly and with relatively little effort. First, the façade is pulled away from the furring strips 46, 50. This can be done by simply removing the screws. Any furring strip 46, 50 interfering with the desired location of the patch panel 60 can be removed either by cutting away or unbolting. Two bolts may be loosened (one on either joint strip 38 on opposite sides of the desired location). The patch panel 60 is then put in place and the bolts refastened. A secondary furring strip can be returned to its original position of modified (cut down) to accommodate the patch panel 60) and then the façade reattached to the furring strips 46, 50. Likewise, a furring strip could have only enough of the bottom portion 46*a* and wall extending up to the upper portion 46*b* removed so that the tab 64 of the patch panel 60 slides under the upper portion and is attached to the joint strip 38.

If the patch panel 60 becomes damaged due to wear, the panel can simply be removed and replaced in a matter of a few minutes without the need to replace a large panel of steel. Additionally, the relatively small size of the patch panel 60 typically eliminates the need to use power equipment as, for example, replacing a 4'×6' piece of hardened steel would require. The patch panel 60 may be attached or removed by a one or two people using hand tools.

Also shown in FIG. 5 is a furring hole 82 which is useful for attaching the secondary furring strips 50 to the ballistic plate 34. When the patch panel 60 is covering the furring holes 82, the furring holes 72 on the patch panel 60 may be used. It will be appreciated that if a furring strip 50 is attached to a patch panel 60, a smaller bracket 58 may be used to adjust for the thickness of the patch panel.

Figure 6:
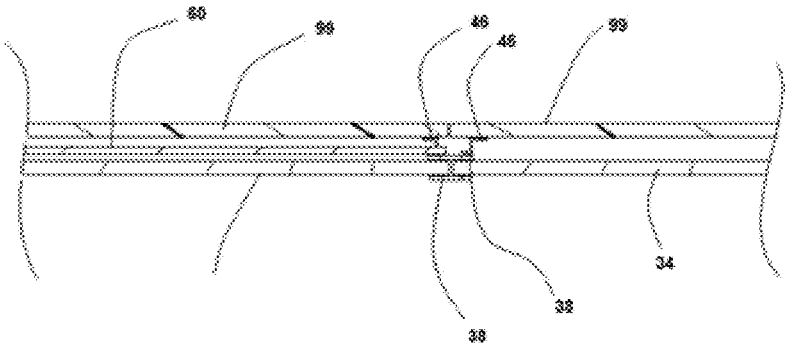
FIG. 6 shows a perspective view of the ballistic wall of FIG. 5 showing the use of three patch panels.

Turning now to FIG. 6, there is shown a perspective view of a modular ballistic wall of FIG. 5. As shown, plate 60*a* is located in the same place and a replacement secondary furring strip 50*a* has been attached. The replacement secondary furring strip 50*a* may be made in a similar manner to the original secondary furring strip 50, but with a notch cut out of the hardened steel portion to accommodate the patch panel 60*a*. A better view of the hardened steel portion 90 of a secondary furring strip 50 is shown on panel 34*a*.

It will be appreciated that the replacement secondary furring strip 50*a* may be the original with the hardened steel cut to accommodate the patch panel 60*a*, or a completely different strip. Moreover, the replacement may not include the hardened steel portion (such as 90) along part or all of the strip depending on the location of the patch panel 60. The replacement secondary furring strip 50*a* may also include a number of holes 92 (only some of which are labeled for clarity) to allow the secondary furring strip to be attached at a variety of locations. Thus, for example, secondary furring strip 50*a* may be attached directly at the top to the hole 72 in the patch panel 60*a* via a bolt (not shown), while a bracket can be used at the bottom to attach the replacement secondary furring strip to the ballistic plate 34. In contrast, replacement secondary furring strip 50*b* is attached by bolts 42*c* and 42*d* to the patch panel 60*b*, and also attached at the top and bottom to the plate 34. The secondary furring strips 50, 50*a* may be cut away to accommodate the patch panels 60, such as secondary furring strip 50 and patch panel 60*c*, or may be sized to accommodate the patch plate as shown in secondary furring strip 50*a* and patch panel 60*a*.

As was mentioned previously, the furring strips 46 which are attached to the joint strips 38 are either replaced or cut away at the location of the patch panel 60. If a gap is left along the furring strip 46, a patch strip 88 can be used to bridge the gap. The patch strip 88 can be a piece of materials, such as aluminum or steel sheet metal, which has an L-shaped cross-section, which is sized to accommodate the patch panel 60. The patch strip 88 can be added, for example, having the patch strip overlap the adjacent furring strip and by placing a self-driving machine screw through overlapping portion.

FIG. 6 also shows the lateral edge 34*b* of plate 34*a*. This shows the plurality of holes 84 (either conventional holes or keyholes) along the edge which allow the joint strips to be attached. The same holes can be used (via a bolt) for attaching the patch panels 60. For example, patch panel 60*c* has a hole 68*a* on the tab 64 which aligns with hole 84*a* in the lateral edge 34*b* of plate 34*a*. Thus, a bolt could pass through the patch penal 60*c*, a joint strip (not shown), the ballistic plate 34*a*, and a joint strip on the back side of the ballistic plate to hold all of the structures together. The same bolt could be used to hold on a furring strip as well. Depending what structures are present will help dictate the length of the bolt.

FIG. 6 further shows the corner joint between plates 34 and plate 34*a* which is disposed at a right angle from the other two plates. Corners such as these create a dilemma in shoot houses. While the joint strips 38 are preferably (though not necessarily) made of hardened steel, bending hardened steel into a 90-degree angle is extremely difficult. Thus, the corner joint strips 38*a* are typically made of mild steel. Thus, the corner joint strip 38*a* is more likely to be damaged by a bullet than the conventional joint strips 38*a*.

One advantage of the present invention is that the tabs 64 of the patch panels 60 allow a narrower corner joint strip to the used. Because the tabs 64 allow vertical overlapping of the plates, a narrower corner joint strip 38*a* can still receive the tabs to hold the patch panels 60 in place. If the patch panels 60 where to touching edge to edge as in prior systems, the joint strip would have to be wider to accommodate the heads of the bolts used to fasten the panels. Thus, while a conventional corner joint strip may be 4-6 inches wide on each leg of the corner joint strip, the present invention can use a corner joint strip 38*a* which is less than 3 inches wide, e.g. 2-2.5 inches—thereby reducing the amount of material subject to damage.

Figure 7:
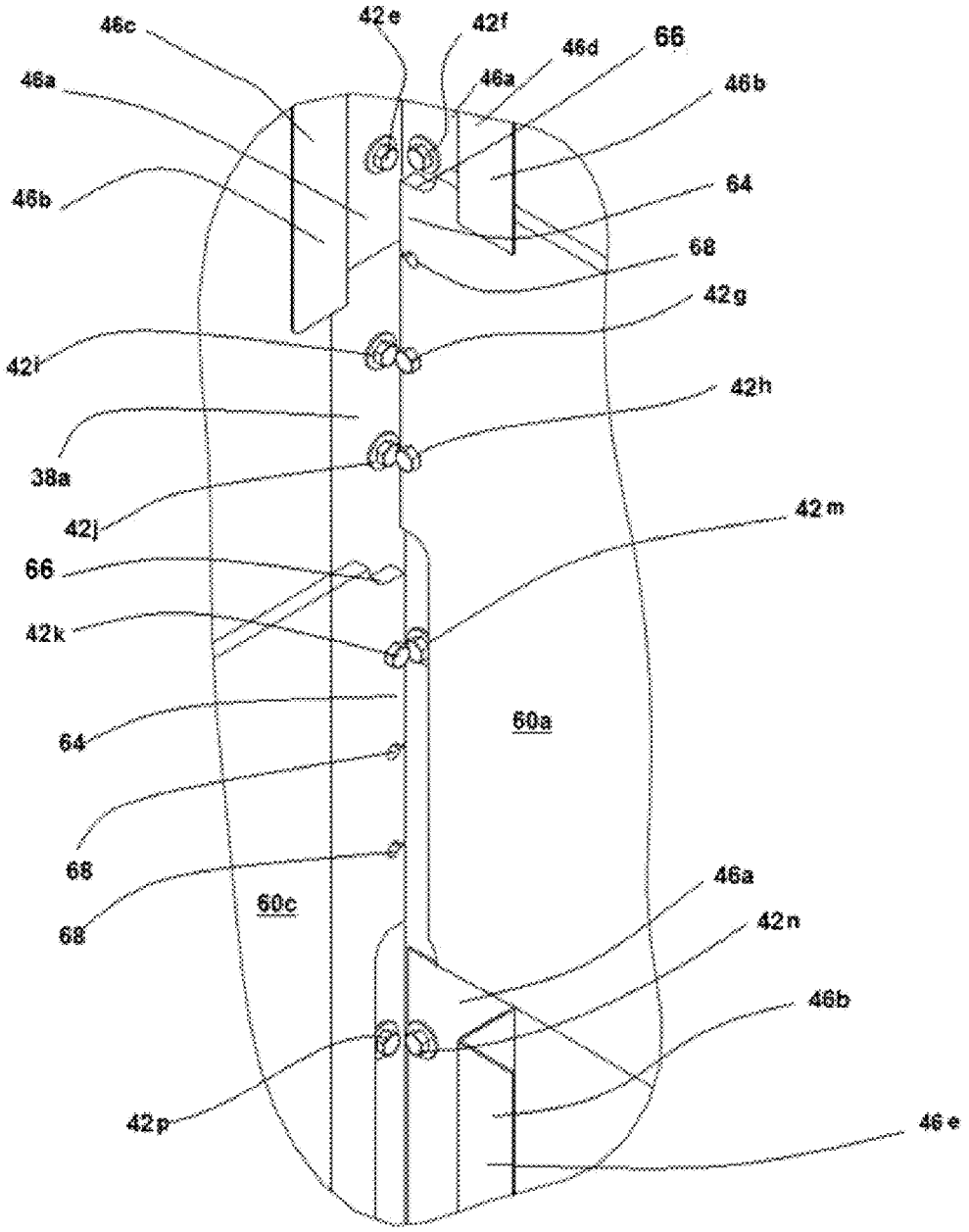
FIG. 7 shows a close-up view of a portion of the corner of the ballistic wall shown in FIG. 6.

Turning now to FIG. 7, there is shown a close-up view of a portion of the corner in the ballistic wall, indicated by circle 7 in FIG. 6, to show the vertical overlapping between the tab 64 of patch panel 60*a* and the tab 64 of the patch panel 60*c* when they are adjacent to one another. As will be appreciated, the joint strip 38*a* includes a plurality of holes (not shown) through which bolts 42 extend to hold the joint strips to the ballistic plates and thereby hold the ballistic plates together. Moreover, these same bolts may be used to hold the furring strips 46*c*, 46*d*, 46*e* to the corner joint strip 38*a*. Starting at the top of the figure, the lower portion 46*a* of furring strip 46*c* is attached to the corner joint strip 38*a* by bolt 42*e*, while the lower portion 46*a* of furring strip 46*d* is attached to the corner joint strip by bolt 42*f*. The tab 64 of patch panel 60*a* has a cut-out 66 to prevent interference with the bolt 42*f* and the furring strips 46*c* and 46*d* have been cut or replaced to make room for the patch panels 60*a* and 60*c*.

It will be appreciated that the holes in the joint strips 38 (FIG. 7) and corner joint strip 38*a* are typically are formed in pairs. Thus, bolts 42*e* and 42*f* are adjacent one another. Moving down, the top hole 68 (which is formed as a keyhole) of tab 64 of patch panel 60*a* does not align with a hole in joint strip. Thus, it is left empty. The next two holes, however do align with holes in the corner joint strip 38*a*, and are filled by bolts 42*g* and 42*h* to secure the patch panel 60*a* in place. Bolts 42*i* and 42*j* are disposed adjacent bolts 42*g* and 42*h* and can hold a portion of the furring strip 46*c* if it were to extend that far, or may simply engage the corner joint strip.

Shortly below the end of tab 64 of patch panel 60*a* is the tab 64 of patch panel 60*c*. Because only one of the holes 68 aligns with a hole in the corner joint strip 38*a*, a single bolt 42*k* is used to secure the right side of patch panel 60*c* to the corner joint strip. Bolt 42*m* is used to hold the corner joint strip 38*a* in place, but does not go through the patch panel 60*a* because the tab 64 of that patch panel has ended. If the patch panel 60*a* had a continuously liner lateral edge, the corner joint strip 38*a* would have to be wider so that the bolt 42*m* could pass through the patch panel.

At the bottom of patch panel 60*a*, furring strip 46*e* commences and is held in place by bolt 42*n*. Bolt 42*p* is disposed vertically under the tab 64 of patch panel 60*c* in a similar manner to bolt 42*m* discussed above regarding patch panel 60*a*. Thus, a fairly narrow corner joint strip 38*a* can be used while still allowing for the attachment of plates on both sides of corner joint strip.

It will be understood that the tabs 64 are preferably less than ½ the height (length of the side) of the patch panels 60. This allows for the patch panels 60 to be inverted if necessary to patch damaged areas on two adjacent ballistic plates at approximately the same height. For example, if the damaged areas were at the same height in FIG. 7, the patch panel 60*c* could be inverted so that the tab extends from the bottom on that side and allowing the two patch panels to be substantially the same height. Thus, two patch panels 60 can be disposed in a common horizontal array to protect damaged areas at approximately the same height on two adjacent plates. Likewise, patch panels can be disposed at different heights depending on the areas of concern on the ballistic plates.

While it was discussed above that a patch strip 88 (FIG. 6) could be used along the furring strip 46 (and omitted from FIG. 7), it will also be appreciated that the furring strip 46 could simply be cut out sufficiently to allow for the patch panel 60 to be put in place. This would include, for example, cutting away the lower portion 46*a* and part of wall leading to the upper portion 46*b* just sufficient to accommodate the additional thickness of the patch panel being inserted thereunder.

Turning now to FIG. 8, there is shown a cross-sectional, fragmented view of a ballistic wall looking down. The wall includes the ballistic plates 34 which are joined together by a pair of joint strips 38. Furring strips 46 extend from the interior joint strip and are attached to a façade, such as pieces of rubber 99 or plywood. On the left side, a patch panel 60 has been added to cover a damaged area of the left ballistic plate 34*d*. On the right side, no patch panel is needed because there is no damage to the plate. Thus, the patch plates 60 can be used where needed without the cost and effort of "belly bands" or similar structures, while extending the life of the plates 34.

In light of the present disclosure, it will be appreciated how simple the method for re-armoring the shoot house can be. During visual inspection of the ballistic plates, the façade is typically removed. Visual inspection is then performed to see if there is damage to the ballistic plates which would traditionally require either replacement of the ballistic plate or the use of a patch. Upon determining that a portion of the ballistic panel has unacceptable wear, the furring strip along the joint strip is at least partially removed, and the secondary furring strip is removed. The patch panel 60 is then aligned with the appropriate holes on the joint strips 38 on either side of the damaged area and bolted in place. A secondary furring strip which accommodates the patch panel is then attached if needed and, if desired, a patch strip is attached to the furring strip so it extends over the patch panel 60. The façade can then be replaced and the shoot house used in its conventional manner.

Not only does the present invention make covering of a damaged ballistic plate easy, a damaged patch panel can be removed and replaced in a very short amount of time. Additionally, because the patch panels only weight about 125 pounds, they can be replaced without the need of lifting equipment if desired.

Thus, there is disclosed a rapid armor panel system. It will be appreciated that numerous changes may be made to the above-disclosed embodiments of target systems and associated methods without departing from the scope of the claims. The appended claims are intended to cover such modifications.

What is claimed is:

1. A modular ballistic wall comprising:

a plurality of ballistic plates including a first ballistic plate having a pair of side edges, and second ballistic plate having an upper end edge and a lower end edge and a pair of side edges, and the first plate and the second plate being disposed side by side so that one side edge of the first ballistic plate is disposed adjacent one side edge of the second ballistic plate;

a plurality of joint strips attached to the plurality of ballistic plates to form a ballistic wall, the plurality of joint strips including a first joint strip disposed to cover the adjacent side edges of the first ballistic plate and the second ballistic plate, and a second joint strip disposed along the other side edge of the second ballistic plate; and a plurality of patch panels attached to the plurality of joint strips and disposed in front of the plurality of ballistic plates, and wherein the plurality of patch panels includes a first patch panel disposed at a first height and a second patch panel disposed at a second height, different from the first height, the second patch panel attached to and extending between the first joint strip and the second joint strip to cover a portion of the second ballistic plate, the second patch panel being positioned with a top of the second patch panel below the upper end edge of the second panel and a bottom of the second patch panel being above the lower end edge of the second ballistic plate.

2. The modular ballistic wall of claim 1, wherein at least one of the plurality of joint strips comprises a corner joint strip.

3. The modular ballistic wall of claim 2, wherein at least two of the patch panels comprise tabs disposed on the end of the patch panels generally coplanar with the patch panels and wherein the at least two patch panels are attached to the corner joint strip so that at least a portion of the tabs are vertically overlapping, and wherein at least a portion each of the two patch panels are disposed at a common height.

4. The modular ballistic wall of claim 3, further comprising a plurality of furring strips formed from sheet metal and wherein at least one of the furring strips has been cut to accommodate placement of a patch panel along the first joint strip.

5. A modular shoot house comprising the modular ballistic wall of claim 1, and further comprising a plurality of modular ballistic walls attached to the modular ballistic wall.

6. A modular ballistic wall comprising;

a plurality of ballistic plates placed side by side so as to form a plurality of joints, the plurality of ballistic plates includes a first ballistic plate and a second ballistic plate, the second ballistic plate having a ballistically damaged area;

at least one first joint strip for attaching the first ballistic plate to the second ballistic plate on a front side and at least one second joint strip attached to the second ballistic plate on an opposing side of the front side; and at least one patch panel having one end attached to the first joint strip and another end attached to the second joint strip and extending in front of and spaced away from the second ballistic plate in front of the damaged area so as to reduce a risk of a projectile contacting the ballistically damaged area.

7. The modular ballistic wall of claim 6, wherein the at least one patch panel has at least one tab extending from the patch panel, the tab being coplanar with the patch panel, the tab having a width which is one half or less of a width of the patch panel and at least one hole formed in the at least one tab.

8. The modular ballistic wall of claim 7, wherein the at least one tab comprises a pair of tabs and wherein each tab of the pair of tabs has at least one hole therein for mounting the at least one patch panel to at least one of the first joint strip and second joint strip, one of the tabs extending from one end of the patch panel and one of the tabs extending from an opposing end of the patch panel in generally opposite directions.

9. The modular ballistic wall of claim 8, wherein one tab of the pair of tabs extends from an upper portion of the patch panel and wherein one tab of the pair of tabs extends from a lower portion of the patch panel.

10. The modular ballistic wall of claim 8, wherein each tab comprises a plurality of holes for mounting the patch panel to a joint strip.

11. The modular ballistic wall of claim 6, comprising a plurality of furring strips formed from sheet metal and wherein at least one of the furring strips has been cut to accommodate placement of the at least one patch panel.

12. The modular ballistic wall of claim 11, wherein at least one furring strip is attached to a patch panel.

13. The modular ballistic wall of claim 11, further comprising at least one patch strip connecting two furring strips.

14. The modular ballistic wall of claim 11, further comprising a façade attached to the plurality of furring strips.

15. The modular ballistic wall of claim 6, wherein the at least one joint strip comprises a corner joint strip having two arms and wherein each of the arms is less than 3 inches long.

16. The modular ballistic wall of claim 6, comprising at least two patch panels disposed in an overlapping horizontal array and being attached to a common joint strip by tabs and wherein the tabs are not disposed in a horizontal array.

17. The modular ballistic wall of claim 6 having a plurality of patch panels attached to one joint strip, wherein one patch panel extends leftwardly from the at least one joint strip and wherein one joint strip extends rightwardly from the at least one joint strip and wherein one tab of one patch panel is vertically overlapping one tab of the other patch panel.

18. The modular ballistic wall of claim 6, wherein the at least one patch panel has a tab which extends outwardly from a main body generally coplanar with the main body, and recesses formed above and below the tab.

19. The modular ballistic wall of claim 6, wherein the second ballistic panel has a first end and a second end not covered by the first joint strip and the second joint strip and wherein the first patch panel is attached to the first joint strip and the second joint strip such that the at least one patch panel is disposed between and spaced away from the first end and the second end.

20. A modular ballistic wall comprising:

a first joint strip and a second joint strip;

a first ballistic plate and a second ballistic plate, the first joint strip being attached to the first ballistic plate and the second ballistic plate by a plurality of bolts; and the second joint strip being held to the second ballistic plate by a plurality of bolts;

at least one first furring strip disposed along the first joint strip for holding a façade in a spaced relationship with the second ballistic plate;

at least one second furring strip disposed along the second joint strip for holding a façade in a space relationship with the second ballistic plate;

a façade attached to the at least one first furring strip and the at least one second furring strip; and a patch plate attached to the first joint strip and the second joint strip; and a patch strip disposed in front of the patch plate and attached to the at least one first furring strip.

* * * * *